US009319808B2

(12) United States Patent
Ruaro

(10) Patent No.: US 9,319,808 B2
(45) Date of Patent: Apr. 19, 2016

(54) HEARING AID HAVING A NEAR FIELD RESONANT PARASITIC ELEMENT

(71) Applicant: GN ReSound A/S, Ballerup OT (DK)

(72) Inventor: Andrea Ruaro, Kbh. NV (DK)

(73) Assignee: GN RESOUND A/S, Ballerup (DK)

( * ) Notice: Subject to any disclaimer, the term of this patent is extended or adjusted under 35 U.S.C. 154(b) by 0 days.

(21) Appl. No.: 13/682,632

(22) Filed: Nov. 20, 2012

(65) Prior Publication Data

US 2014/0140554 A1 May 22, 2014

(30) Foreign Application Priority Data

Nov. 19, 2012 (EP) ..... 12193225

(51) Int. Cl.
*H04R 25/00* (2006.01)

(52) U.S. Cl.
CPC ..... *H04R 25/554* (2013.01)

(58) Field of Classification Search
CPC ..... H04R 25/00; H04R 25/55; H04R 25/554; H04B 5/00
See application file for complete search history.

(56) References Cited

U.S. PATENT DOCUMENTS

| | | | | |
|---|---|---|---|---|
| 5,966,097 | A | 10/1999 | Fukusawa et al. | |
| 7,372,373 | B2 * | 5/2008 | Borisov et al. | 340/870.02 |
| 7,646,356 | B2 * | 1/2010 | Adel et al. | 343/895 |
| 2006/0093174 | A1 * | 5/2006 | Niederdrank et al. | 381/317 |
| 2008/0014872 | A1 * | 1/2008 | Tucek et al. | 455/106 |
| 2008/0205678 | A1 | 8/2008 | Boguslavskij et al. | |
| 2009/0253397 | A1 * | 10/2009 | Shanks et al. | 455/271 |
| 2010/0128907 | A1 * | 5/2010 | Dijkstra et al. | 381/315 |
| 2010/0135513 | A1 | 6/2010 | Geschiere et al. | |
| 2010/0321269 | A1 | 12/2010 | Ishibana et al. | |
| 2011/0156972 | A1 | 6/2011 | Korva et al. | |
| 2011/0312393 | A1 * | 12/2011 | Pulimi et al. | 455/575.7 |
| 2012/0070024 | A1 * | 3/2012 | Anderson | 381/328 |

(Continued)

FOREIGN PATENT DOCUMENTS

| | | | |
|---|---|---|---|
| CN | 1798455 | A | 7/2006 |
| EP | 2391026 | A2 | 11/2011 |

OTHER PUBLICATIONS

Second Technical Examination dated Oct. 30, 2013 for related Danish Patent Application No. PA 2012 70715, 3 pages.

(Continued)

*Primary Examiner* — Duc Nguyen
*Assistant Examiner* — Taunya McCarty
(74) *Attorney, Agent, or Firm* — Vista IP Law Group, LLP

(57) ABSTRACT

A hearing aid includes: a microphone for reception of sound and conversion of the received sound into a corresponding first audio signal; a signal processor for processing the first audio signal into a second audio signal compensating a hearing loss of a user; a speaker connected to an output of the signal processor for converting the second audio signal into an output sound signal; a transceiver connected to the signal processor for wireless data communication; and an antenna for emission and reception of an electromagnetic field, the antenna coupled with the transceiver; wherein the signal processor, the transceiver, the antenna, and interconnecting transmission lines form a circuitry extending over an area of a support substrate, and wherein the hearing aid further comprises a resonant element within a near field of the circuitry to terminate and dissipate unwanted electromagnetic radiation from at least a part of the area.

16 Claims, 8 Drawing Sheets

(56) References Cited

U.S. PATENT DOCUMENTS

| | | | | |
|---|---|---|---|---|
| 2012/0094717 | A1 | 4/2012 | Bahramzy | |
| 2012/0189146 | A1 * | 7/2012 | Wuidart | 381/312 |

OTHER PUBLICATIONS

Third Technical Examination—Intention to Grant dated May 2, 2014 for related Danish Patent Application No. PA 2012 70715, 2 pages.
First Technical Examination and Search Report dated Mar. 27, 2013 for Danish Patent Application No. PA 2012 70715.
Extended European Search Report dated Apr. 4, 2013 for EP Patent Application No. EP 12193225.5.
Notification of First Office Action dated Nov. 27, 2014, for corresponding Chinese Patent Application No. 201310583546.X, 13 pages.
Notification of Reasons for Rejection dated Aug. 5, 2014 for corresponding Japanese Patent Application No. 2013-237715, 10 pages.
Masamitsu Maekawa, "Wireless Communication Technology, Antenna Design: Exploitation of Development Idea for NEC Meta-atoms 'Application' Antenna (4/4)", EE Times Japan, Apr. 26, 2012, 5 pages.

* cited by examiner

HEARING AID HAVING A NEAR FIELD RESONANT PARASITIC ELEMENT

RELATED APPLICATION DATA

This application claims priority to and the benefit of Danish Patent Application No. PA 2012 70715, filed on Nov. 19, 2012, pending, and European Patent Application No. EP 12193225, filed on Nov. 19, 2012, pending, the disclosures of both of which are expressly incorporated by reference in their entireties herein.

FIELD

The application relates to electronic devices, such as to hearing aids and hearing accessories, and especially to devices having a resonant element, such as a near field resonant parasitic element, for filtering unwanted electromagnetic radiation from e.g. transceiver and antenna elements.

BACKGROUND

In the ever increasing number of electronic devices being used worldwide, electromagnetic compatibility, EMC, regulations need to be complied with to obtain approval of the devices.

Designers are facing further issues in keeping the emitted radiation below the limits due to factors like increased clock speed, coexistence of digital and analogue systems, shrinking of PCB dimensions, etc. This is especially the case with devices where the space is critical such as in hand held terminals, mobile phones or medical implants and devices. Often, the space is so limited that there is no room for traditional solutions regarding for example grounding, filtering, and shielding.

It is known in the art to provide shielding by encapsulating electronic devices in for example a metal house to avoid any radiation from the electronic devices at all. However, as more electronic devices are configured for wireless communication with other devices, external to the electronic device, this approach has its obvious drawbacks as not only noise signals are trapped but also the wireless signals could be trapped.

It is seen in the art that there sometimes is a need to attenuate a narrow frequency band or even a single frequency and its higher-order harmonics due to the nature of clock circuits, switched mode power supplies, micro wave power amplifiers and voltage-controlled oscillators, resonance phenomena in the structures, etc. which may produce unwanted radiation in a narrow frequency band.

It is known in the art to provide filtering for a transmission line, however, traditional filters typically filter a broad section of frequencies which is a disadvantage when a transmission line needs filtering for a frequency that is very close to the operating frequency for the device.

Examples of such prior art approach include electromagnetic band gap structures which have been developed in order to mitigate the interference caused by high speed digital and analogue traces on printed circuit boards. However, such structures tends to be quite large, and too large to use with small printed circuit boards. Typically, the filtering is done with lumped elements which are not practically implementable in small devices. Thus, the electrical and physical dimensions of such electromagnetic band gap structures are not suitable for applications using small printed circuit boards.

Especially for electronic devices being subject to space restrictions, such as mobile phones, medical implants, hearing instruments and hearing instrument accessories, there is a need for an improved filtering in order to mitigate the interference caused by e.g. high speed digital and analogue traces on printed circuit boards.

SUMMARY

It is an object to provide an improved filtering especially for electronic devices being subject to space restrictions, such as mobile phones, medical implants, hearing aids and hearing aid accessories.

According to a first aspect of some embodiments, a hearing aid is provided, the hearing aid comprising a microphone for reception of sound and conversion of the received sound into a corresponding first audio signal, a signal processor for processing the first audio signal into a second audio signal compensating a hearing loss of a user of the hearing aid, a speaker that is connected to an output of the signal processor for converting the second audio signal into an output sound signal, and a transceiver connected to the signal processor for wireless data communication interconnected with an antenna for emission and reception of an electromagnetic field. Electrical circuitry may comprise at least one, such as of least two of the signal processor, the transceiver, interconnecting transmission lines, antenna structures and/or further electrical components. The electrical circuitry may extend over an area of a support substrate, such as a printed circuit board. The hearing aid may further comprise a resonant element, such as a near field resonant parasitic element, being positioned within the near field of the electrical circuitry to terminate and dissipate unwanted electromagnetic radiation from at least a part of the area.

In a further aspect of some embodiments, a hearing aid accessory is provided, the hearing aid accessory comprising a signal processor for processing signals, a transceiver connected to the signal processor for wireless data communication interconnected with an antenna for emission and reception of an electromagnetic field. Electrical circuitry may comprise at least one, such as at least two, of the signal processor, the transceiver, interconnecting transmission lines, and/or further electrical components and may extend over an area of a support substrate, such as a printed circuit board. The hearing aid accessory may further comprise a resonant element, such as a near field resonant parasitic element, being positioned within the near field of the electrical circuitry to terminate and dissipate unwanted electromagnetic radiation from at least a part of the area.

A hearing aid accessory may be any device for communication with the hearing aid and may for example be a remote control, a telephone, a television, a television box, a television streamer box, a spouse microphone, a hearing aid fitting system, etc.

In another aspect of some embodiments, an electronic device is provided, the electronic device having an electromagnetic filtering element for reducing unwanted electromagnetic radiation, the electronic device comprising an electrical circuitry having at least one radiator, such as a radio, a transceiver, an oscillator, a transmission line, etc. The electrical circuitry may extend over an area of a support substrate and may comprise one or more, such as at least two, of the following elements: digital electrical circuitry, a signal processor, a transceiver, interconnecting transmission lines, and further electrical components, the electromagnetic filtering element comprising a resonant element, such as a near field resonant parasitic element, being positioned within the near field of the electrical circuitry to terminate and dissipate unwanted electromagnetic radiation from at least a part of the area.

In a still further aspect of some embodiments, a method of reducing or eliminating electromagnetic noise from an electrical circuitry extending over an area of a support substrate is provided. The electrical circuitry has a radiator configured to radiate in a first frequency band, the electromagnetic noise being radiated from the electrical circuitry in a second frequency band different from the first frequency band. The method comprising receiving the electromagnetic noise radiated from at least a part of the area by a resonant element positioned in the near field of the electrical circuitry, the resonant element being configured to resonate in the second frequency band, dissipating the electromagnetic noise received from at least a part of the area through a connection to a ground potential through a dissipating element.

It is an advantage that a noise signal emitted from an electronic circuit extending over an area of a support substrate may be reduced or eliminated. In some devices, the source of a noise signal may not be well known, so that the filtering of specific transmission lines or antenna structures may not reduce the noise signal sufficiently for the device to comply with e.g. various EMC regulations. Therefore, it is an advantage that a filtering of more than one electrical component may be achieved through a same filtering element, such as through a same resonant element. It is a further advantage that unwanted electromagnetic radiation may be dissipated through a resonant element even though the exact source of the unwanted electromagnetic radiation is not known. Especially for electronic devices having electrical circuitry comprising a radiator, one or more embodiments described herein prove advantageous.

The hearing aid may be a binaural hearing aid, and the transceiver interconnected with an antenna for emission and reception of an electromagnetic field in one hearing aid of a binaural hearing aid may be configured for wireless data communication with another hearing aid of the binaural hearing aid.

One or more embodiments described herein are particularly advantageous for small electronic devices, such as for electronic devices where the space requirement is a critical factor such as in hand held terminals, mobile phones or medical implants and devices, hearing aids and hearing aid accessories.

Typically, the electrical circuitry is provided on a substrate, such as a dielectric substrate, such as a support substrate having a dielectric layer, such as a printed circuit board, a flex foil, a copper foil, etc.

Typically, the substrates, such as the printed circuit boards, have an area of less than 1 $cm^2$, such as less 0.50 $cm^2$, such as less than 0.25 $cm^2$, typically, such as equal to or less than 0.16 $cm^2$, such as equal to or less than 0.04 $cm^2$. The substrate is typically no smaller than 0.25 $mm^2$ (0.5 mm×0.5 mm), and the substrate may thus be larger than 0.25 $mm^2$. One or more embodiments described herein may also be advantageous for high-complexity printed circuit boards of any size. The electrical circuitry may substantially cover the substrate, or the electrical circuitry may cover at least 50% of the substrate area, such as at least 75%, such as at least 80%, such as at least 90%, such as typically covering substantially the entire substrate.

The electrical circuitry may extend over an area having a first length and a first width, thus, the electrical circuitry may have a first length and a first width. In one or more embodiments, the resonant element has a first section, and the length of the first section is greater than the first length and the width of the first section is less than the first width.

The length of the resonant element, such as the efficient length of the resonant element, be at least one wavelength, such as at least quarter of a wavelength.

The resonant element may be positioned within the near field of the electrical circuitry to terminate and dissipate unwanted electromagnetic radiation from at least a part of the electrical circuitry. Thus, the resonant element may terminate and dissipate unwanted electromagnetic radiation from at least a part of the area on which the electrical circuitry is distributed.

The "near field" of the electrical circuitry may be defined to be the "field" within one wavelength of the unwanted electromagnetic radiation as taken from the source of the unwanted electromagnetic radiation, such as from the electrical circuitry.

The resonant element is typically substantially electrically conductive. The resonant element may be a parasitic antenna element. The resonant element may be positioned outside any signal paths of the electrical circuitry, and is typically not electrically connected to anything but a ground potential.

It is an advantage that the resonant element may implement a filter effect for one or more components simultaneously, and thus, the resonant element may be configured to be positioned in the near field of at least two electrical components, where the electrical components are transmission lines, bonding wires, IC chips, transceivers, capacitors and/or resistors, etc. to thereby provide a filtering effect for the at least two electrical components. The resonant element may thus be positioned to filter unwanted electromagnetic radiation from an area comprising the at least two electrical components.

In one or more embodiments, the resonant element is positioned electrically close to one or more radiating elements, such as radio(s), oscillator(s), or transmission line(s). This facilitates coupling from the radiating element(s) to the resonant element. The resonant element is configured such as not to re-radiate the electromagnetic radiation received, for example by having a connection from the parasitic element to a ground potential. Advantageously, the resonant element is connected to the ground potential via energy dissipating means, such as via a resistor, a low radiation efficiency element, etc.

In one or more embodiments, the parasitic element is connected to the ground potential via a rechargeable battery. Hereby, the current induced in the parasitic element due to the received electromagnetic radiation, is used to charge the battery. Thus, for example in a hearing aid, the resonant element may be connected to a ground potential through a battery of the hearing aid. Hereby, the battery is charged by current captured by the resonating parasitic element.

Due to the resonant behaviour of the resonant element, the resonant element may implement a notch filter for frequencies in a narrow bandwidth around a specified centre frequency.

In one or more embodiments, the resonant element is a meander shaped element or a split ring resonator element, or the resonant element may comprise an open loop. The resonant element may for example be a closely-spaced meandered structure, a capacitively loaded loop element (CLL element), etc.

In a meander shaped or "S" shaped resonant element, the length of the element, i.e. the length of the unfolded element, determines the inductance L, and the distance between the segments determine the capacitance C. Thus, the resonant frequency for the resonant element having an effective length L and an efficient capacitance C is given by $2\pi f=\lambda/\sqrt{(L*C)}$, where $\lambda$ is the effective wavelength in the medium and f is the unwanted frequency for which the resonant element is designed. The meander shaped structure may be implemented as a wire, a strip element, etc. typically formed in a conducting material, such as a metal, such as copper, gold, etc.

It is envisaged that the meander shaped resonant element may have any shape, it may be a curved S-shape, it may be a square S-shape, it may comprise a plurality of bends, such as 2, 3, 4, 5, 6 bends. In one or more embodiments, a first section of the resonant element may extend in a first direction and a second section of the resonant element may extend in a second direction, the first direction being orthogonal to, or non-orthogonal, i.e. such as forming an angle different from 90 degrees, to the second direction.

For one or more embodiments, the resonant element may comprise an open loop element or a split ring resonator, SRR, the split ring resonator may be formed by two concentric open loops, typically of a non-magnetic metal, separated by a gap, and each having a split in the loop, the splits being positioned at opposite sides of the loops. The loops may be circular, square, rectangular, quadratic, etc., and the geometrical parameters of the split ring resonators, i.e. the split gap width, gap distance, metal width and radius determine the properties of the split ring resonator. A split ring resonator having a single set of rings is typically referred to as a single cell element.

For a single cell split ring resonator having a pair of enclosed loops with a gap between them, a magnetic flux penetrating the metal loops will induce rotating currents in the loops, which produce their own flux to enhance or oppose the incident field, depending on the resonant properties of the split ring resonator. Due to splits in the loops the structure may support resonant wavelengths much larger than the diameter of the loops, a property which is not seen when using closed loops, and the small gaps between the loops may provide large capacitance values. Typically, the dimensions of the structure are small compared to the resonant wavelength, thus a high resonant frequency may be obtained in a limited space.

Typically, an input capacitance of the resonant element may be greater than zero.

The parasitic element may be a planar element and may be provided as a planar parasitic element on e.g. a printed circuit board.

For example, in one or more embodiments wherein the support substrate is a printed circuit board, the printed circuit board may have a first layer being a top signal layer comprising at least a part of the electrical circuitry, a second, middle layer comprising the resonant element and a third, bottom layer comprising a ground plane. It is envisaged that also other multilayered structures may be used having for example one, two or more signal layers above a layer comprising the resonant element, and one, two or more signal layer below the layer comprising the resonant element.

The transceiver antenna in the electronic device, such as in the hearing aid, in the hearing accessory, etc., may be configured to have a first resonant frequency, and the resonant element may be configured to have a second resonant frequency, and in some embodiments, the first resonant frequency is different from the second resonant frequency.

In one or more embodiments, the resonant element may be configured to have a resonance frequency being within +/−10%, such as within +/−15%, such as within +/−20% of a frequency emitted by the hearing aid transceiver antenna, i.e. of the first resonant frequency.

It is envisaged that the power radiated from the electronic device receiver, such as from the hearing aid transceiver or the hearing aid accessory transceiver at the first resonant frequency is higher than the unwanted power radiated at an unwanted frequency to which the resonant frequency of the resonant element is tailored.

The resonant element may be suitable for radiating an electromagnetic field at frequencies greater than 1 GHz.

The resonant element may be suitable for radiating a first power at a first resonant frequency and a second power at a frequency different from the first frequency, the first power being greater than the second power, thus the resonant element is tailored to be best suitable for radiating about the resonance frequency. However, it is envisaged that in one or more embodiments, the resonant element is, even though suitable to radiate, configured to dissipate energy received by the resonator.

The operating frequency for the electronic device, such as the hearing aid and/or the hearing aid accessory may be configured for operation in the ISM frequency band. The devices may be configured for operation at a frequency of at least 1 GHz, such as at a frequency between 1.5 GHz and 3 GHz such as at a frequency of 2.4 GHz. Particularly, the frequency of the hearing aid antenna may be at least 1 GHz.

The unwanted frequency may be any frequency around the operating frequency for the electronic device, and the unwanted frequency may be equal to or below 2.1 GHz, or above or equal to 2.7 GHz. In one or more embodiments, the unwanted frequency is at or about 2.7 GHz and the resonant element is configured to filter signals at or about 2.7 GHz.

In accordance with some embodiments, a hearing aid includes: a microphone for reception of sound and conversion of the received sound into a corresponding first audio signal; a signal processor for processing the first audio signal into a second audio signal compensating a hearing loss of a user of the hearing aid; a speaker that is connected to an output of the signal processor for converting the second audio signal into an output sound signal; a transceiver connected to the signal processor for wireless data communication; and an antenna for emission and reception of an electromagnetic field, the antenna coupled with the transceiver; wherein the signal processor, the transceiver, the antenna, and interconnecting transmission lines form a circuitry extending over an area of a support substrate, and wherein the hearing aid further comprises a resonant element within a near field of the circuitry to terminate and dissipate unwanted electromagnetic radiation from at least a part of the area.

In one or more embodiments, the resonant element comprises a notch filter filtering the unwanted electromagnetic radiation.

In one or more embodiments, the resonant element comprises a near field resonant parasitic element positioned outside any signal paths of the circuitry.

In one or more embodiments, the area comprises at least two electrical components.

In one or more embodiments, the resonant element is connected to a ground potential through an energy dissipating component.

In one or more embodiments, the antenna has an operating frequency that is at least 1 GHz.

In one or more embodiments, the resonant element is configured to filter signals at about 2.7 GHz.

In one or more embodiments, the hearing aid further includes a battery, wherein the resonant element is connected to a ground potential through the battery of the hearing aid.

In one or more embodiments, the battery is charged by current captured by the resonant element.

In one or more embodiments, the resonant element comprises a meander shaped element.

In one or more embodiments, the resonant element comprises a split ring resonator element.

It will be appreciated that embodiments described in connection with one of the aspects described herein may equally be applied to the other aspects.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only exemplary embodiments and are not therefore to be considered limiting in the scope of the claims. Like reference numerals refer to like elements throughout. Like elements will, thus, not be described in detail with respect to the description of each figure.

DETAILED DESCRIPTION

Figure 1:
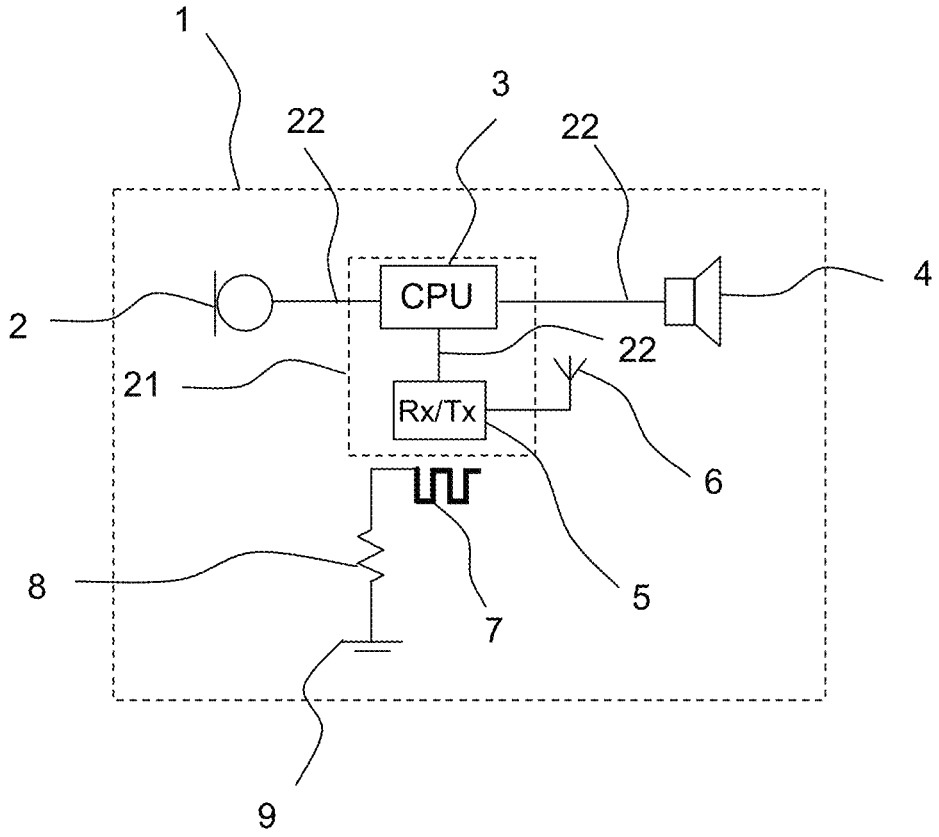
FIG. 1 shows a circuit diagram of a hearing aid having wireless communication means and a resonant element.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not explicitly described.

In FIG. 1, a circuit diagram of an electronic device 1 having wireless communication means 5, 6 is shown. The electronic device 1 is a hearing aid 1 comprising a microphone 2 for reception of sound and conversion of the received sound into a corresponding first audio signal, a signal processor 3 for processing the first audio signal into a second audio signal compensating a hearing loss of a user of the hearing aid 1, a speaker 4 that is connected to an output of the signal processor 3 for converting the second audio signal into an output sound signal, a transceiver 5 connected to the signal processor 3 configured for wireless data communication and being interconnected with an antenna 6 for emission and reception of an electromagnetic field. An electrical circuitry 21 comprises one or more of the signal processor 3, the transceiver 5, interconnecting transmission lines 22, antenna structures 6 and/or further electrical components. In FIG. 1, the electrical circuitry 21 is exemplary shown as comprising at least two electrical components, i.e. the electrical circuitry 21 is shown as comprising the transceiver 5, the signal processor 3 and parts of interconnecting transmission lines 22. It is seen that the electrical circuitry extends over an area 21, such as over an area of a support substrate (not shown). The area being defined by a length and a width of the dotted box on the substrate. The hearing aid 1 further comprises a resonant element 7 being provided within the near field of at least the electrical circuitry 21. The resonant element 7 is connected to a ground potential 9 via dissipating element 8, being a resistor in the present example, to thereby terminate and dissipate unwanted electromagnetic radiation from at least a part of the area occupied by the electrical circuitry 21.

The resonant element is in the present embodiment a near field resonant parasitic element and implements a microwave filter. The design of the resonant element may be similar to a microwave filter, but unlike a usual microwave filter the signal is not routed through it, i.e. the resonant element is detached from the electrical circuitry, and is provided outside of any signal paths of the hearing aid electronics, and particularly outside any signal paths of the electrical circuitry. Given that the hearing aid typically operates at about 2.4 GHz, and that the near field is characterised as the field within approximately one wavelength of the electronic device, the resonant element will be within the near field of most of the electronic components in the hearing aid. The filter may be a notch filter having a narrow stop frequency band.

A microwave filter designed to be resonant at 2.7 GHz may be more efficient than a normal circuit filter with analog components. Thus, it is possible to filter at 2.7 GHz without much interference at 2.4 GHz. However, it does take up some space dependant on the filter frequency, and, depending on where the resonant element is positioned, an extra layer of e.g. printed circuit board may be needed.

Figure 2:
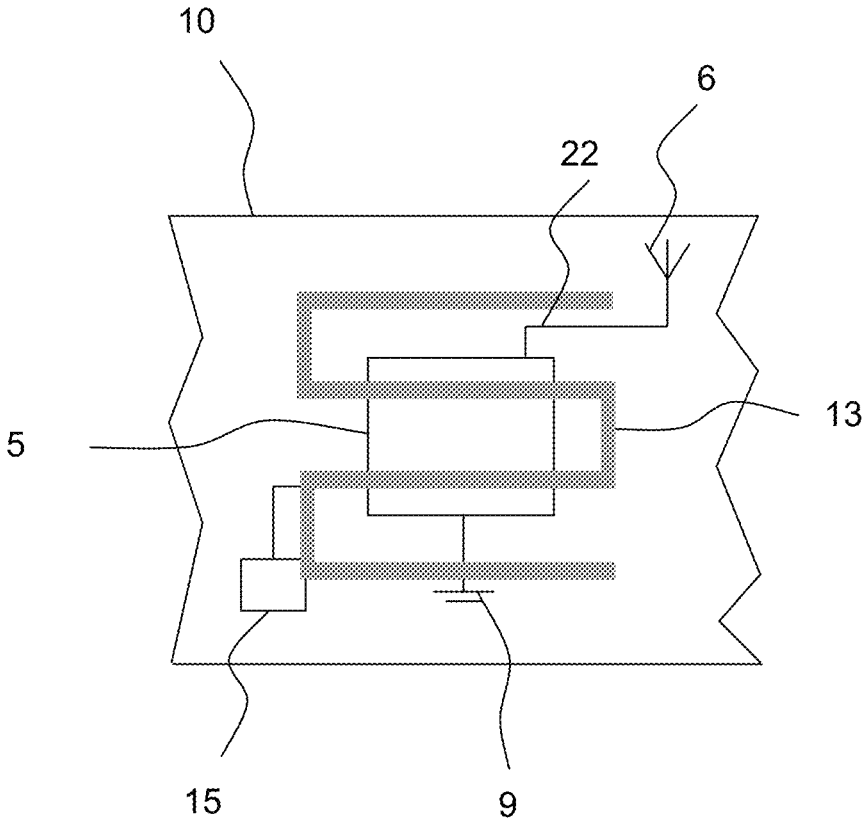
FIG. 2 shows schematically another embodiment wherein the resonant element is provided beneath the chip to be filtered.

In FIG. 2, another embodiment is shown schematically. An IC chip 5 is positioned on a top PCB layer 10, the IC chip 5 being in this case the radio with a transmission wire 22 to the antenna 6. The IC chip is connected to another chip 15, such as for example a clock generator, and the IC chip also has a connection to the ground 9. Beneath the chip, in an intermediate PCB layer, the meander shaped resonant element 13 is placed, and it is seen that the meander shaped resonant element 13 covers an area wider than the area of the radio, i.e. wider that the area of the IC chip 5.

Figure 3A:
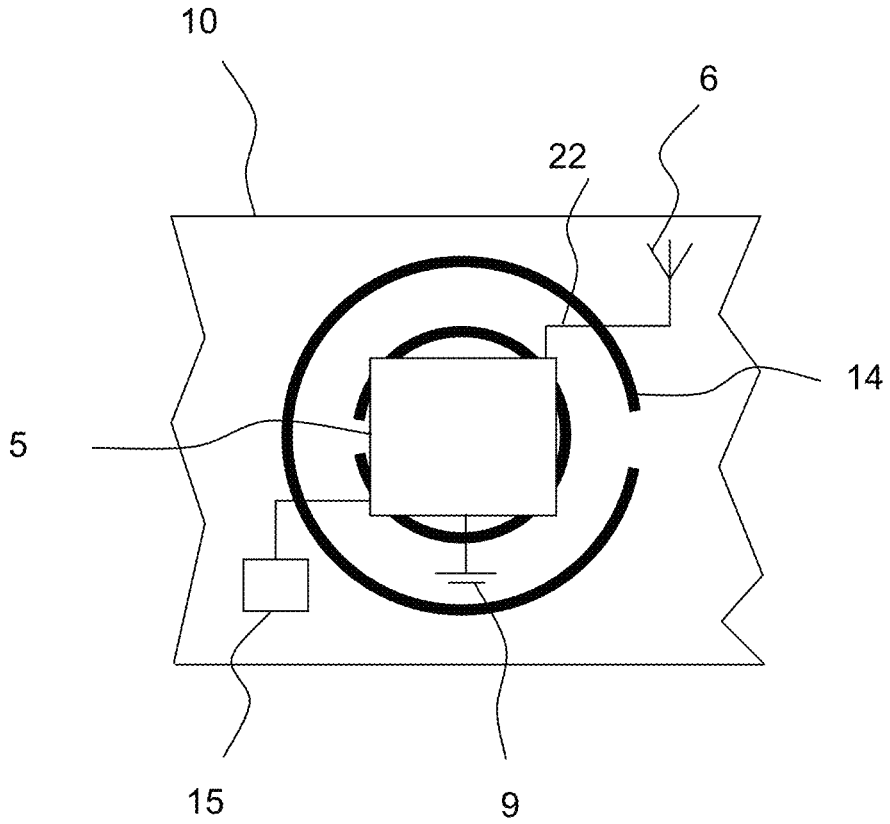
FIG. 3*a* shows schematically another resonant element configured to be positioned below the chip to be filtered.
Figure 3B:
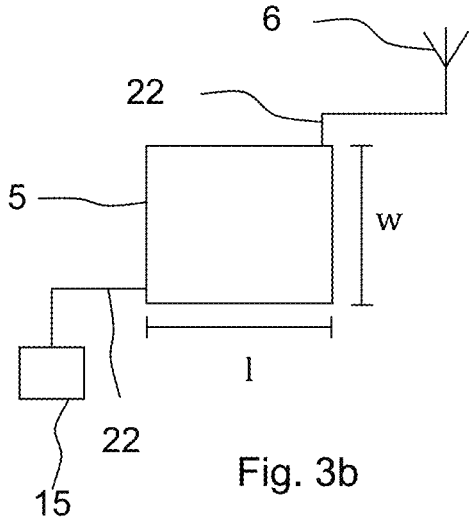
FIG. 3*b* shows schematically the electrical circuitry to be filtered, and the dimensions of a chip to be filtered.

In FIG. 3*a*, the same PCB as in FIG. 2 is shown, however, beneath the chip, in an intermediate PCB layer, the resonant element 14 is shown to be a split ring resonator element 14. It is seen that the meander shaped resonant element 14 covers an area wider than the area of the radio, i.e. the area of the IC chip 5. In FIG. 3*a*, the electronics on PCB 10 are shown schematically, with the resonant element and the PCT not shown. It is seen that the IC chip has a length, $l_{IC}$, and a width, $w_{IC}$. The resonant element 14 as shown in FIG. 3*a*, may be provided in the near field of the IC chip and may filter an unwanted signal from the IC chip. Typically, also unwanted signals emanating from transmission lines 22, the other chip 15 and antenna 6 may be filtered by positioning the resonant element 14 within the near field of these elements.

Figure 4A:
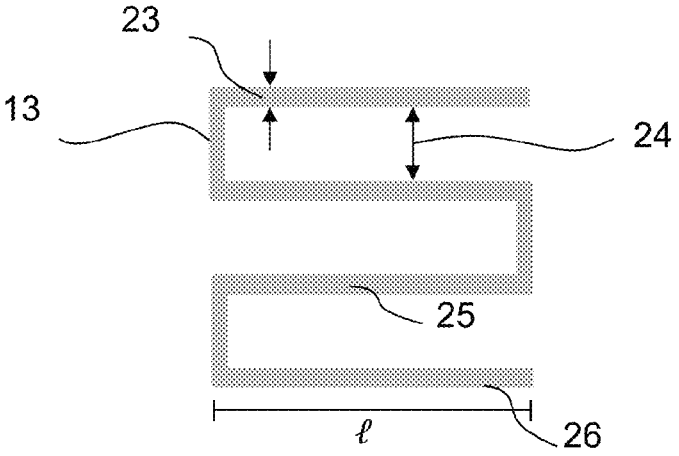
FIGS. 4*a*-4*c* show schematically exemplary embodiments of the resonant element.
Figure 4B:
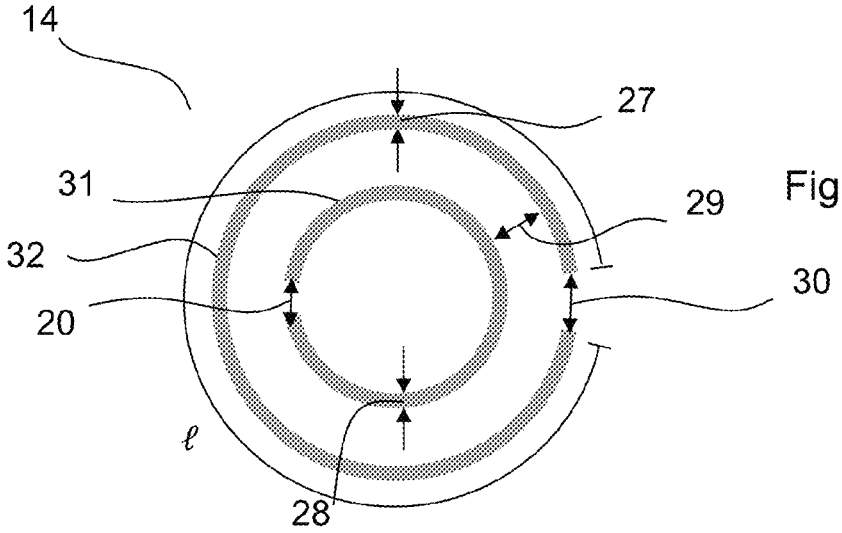
Figure 4C:
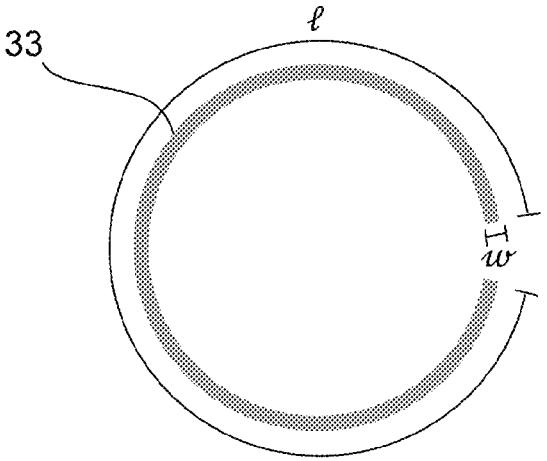

FIGS. 4*a*-4*c* show different structures of a resonant element. In FIG. 4*a*, a meander shaped resonant element 13 is shown. The meandering strip of the resonant element has a width 23 and a distance 24 between each section. The length of the unfolded element determines the inductance L, and the distance 24 between the sections 25, 26 determines the capacitance C of the resonant element. Each section 25. 26 have a length $l_{sec}$. It is envisaged that the meander shaped resonant element may have any shape, it may be a curved S-shape, it may be a square S-shape, it may comprise a plurality of bends, such as 2, 3, 4, 5, 6, etc. bends. In one or more embodiments, a first section 25 of the resonant element may extend in a first direction and a second section 26 of the resonant element may extend in a second direction, the first direction being orthogonal to, or non-orthogonal, i.e. such as forming an angle different from 90 degrees, to the second direction.

In FIG. 4*b*, a split ring resonant element 14 is shown. The split ring resonator is made of two concentric rings, 31, 32, an inner ring 31 and an outer ring 32, separated by a gap having a width 29, both concentric rings 31, 32 having splits 30, 20 at opposite sides. Each ring has a width 27, 28 and the folded out length lo,i of each ring is the effective length. The distance between the inner ring and the outer ring is 29. In FIG. 4*c*, a resonant element 33 being a single open loop is shown. The single open loop having a length lloop and a width wloop.

Figure 5:
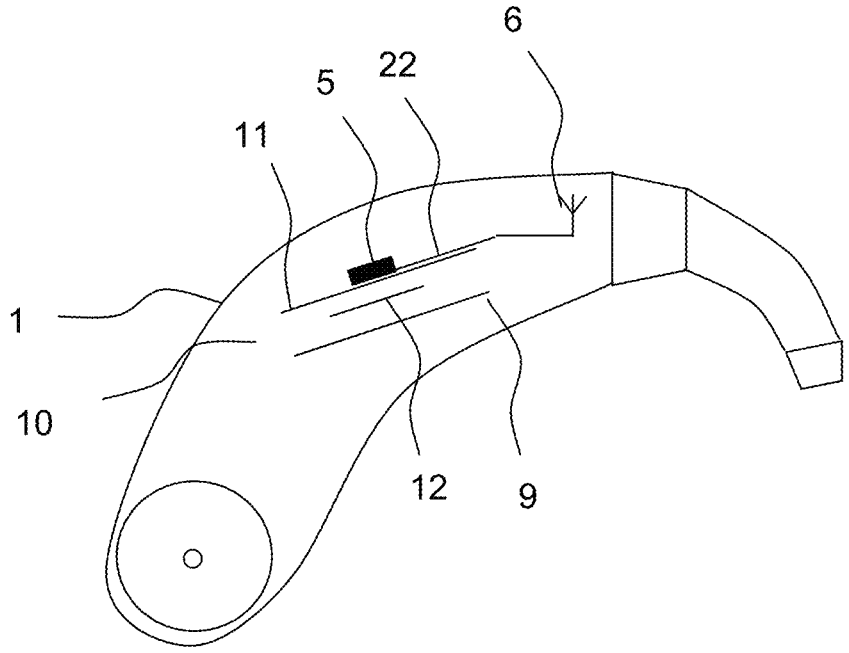
FIG. 5 shows a hearing aid and an exemplary configuration of the elements implemented in a layered printed circuit board structure.

In FIG. 5, a hearing aid 1 is shown, and the configuration of the elements within the hearing aid 1 is shown schematically. The support substrate 10 is a printed circuit board 10, and the printed circuit board may have a first layer 11 being a top signal layer comprising at least a part of the electrical circuitry, exemplified by IC chip 5, transmission line 22 and antenna 6, a second, middle layer 12 comprising the resonant element 7, 13, 14, 33 such as the near field resonant parasitic element, and a third, bottom layer 9 comprising a ground plane. The resonant element configured to perform a filtering of the electrical circuitry, i.e. the resonant element is implemented as a microwave filter, and is located between the top layer 11 and bottom layer 9. It is envisaged that also other multilayered structures may be used having for example one, two or more signal layers above the layer comprising the resonant element, and one, two or more signal layer below the layer comprising the resonant element may also be provided.

Figure 6:
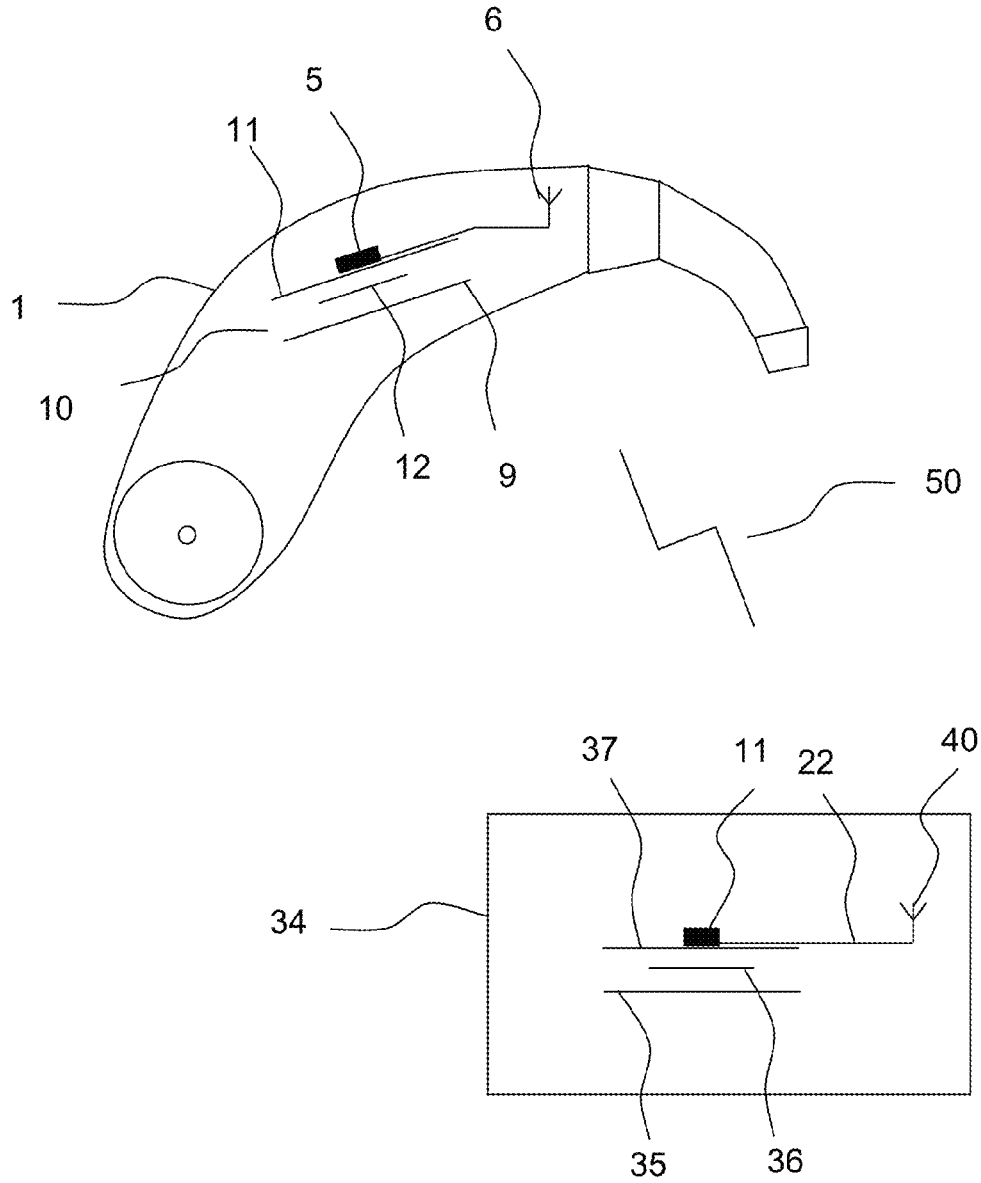
FIG. 6 shows a hearing aid as in FIG. 5 configured to communicate with a hearing aid accessory.

In FIG. 6, a hearing aid 1 and an accessory electronic device 34, such as an external electronic device, is provided. The hearing aid 1 in FIG. 6 corresponds to the hearing aid 1 as shown in FIG. 5. Both the hearing aid 1 and the accessory electronic device 34 is shielded with respect to electromagnetic radiation by the resonant element 7, 13, 14, 33 implemented as a filter element, such as a notch filter.

The accessory electronic device 34 comprises a substrate having a top substrate layer 37, the top layer 37 comprising signal electronics, exemplified by IC chip or electrical component 11, transmission line 22 and antenna 40. An intermediate substrate layer 36 comprises the resonant element 7, 13, 14, 33 (not shown), and a third bottom layer 35 comprises a ground potential. The resonant element 7, 13, 14, 33 is connected to the ground potential in the third bottom layer 35 via a dissipating element (not shown). It is envisaged that the resonant element also may be positioned in the first top layer 37, e.g. as shown in FIG. 1.

The hearing aid 1 and the accessory electronic device are configured to communicate via antennas 6, 40, i.e. via wireless connection 50.

Figure 7:
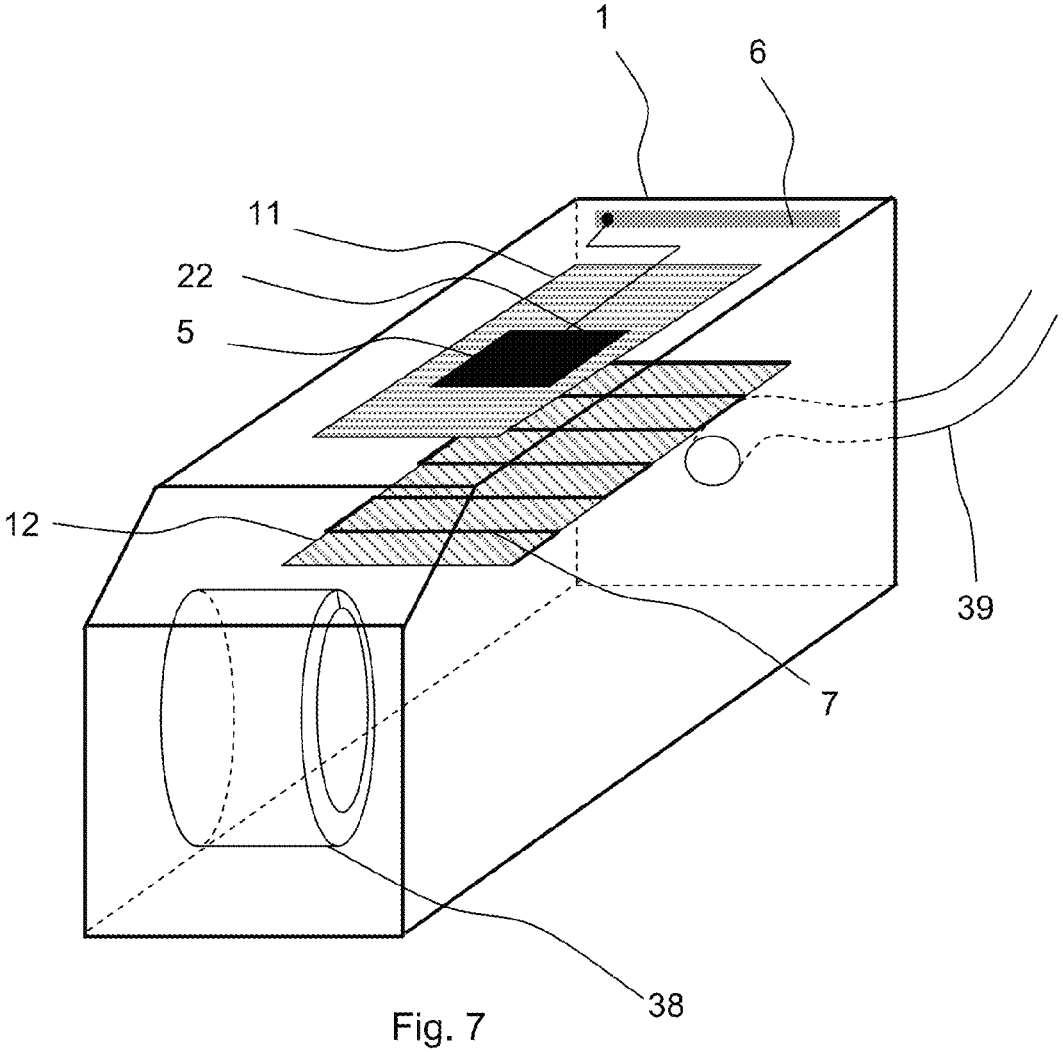
FIG. 7 shows a 3D structure of the hearing aid comprising the resonant element 7.

In FIG. 7, a 3D structure of the hearing aid 1 and the resonant element 7 is shown. The ground potential has been omitted for clarification. The top layer 11 comprises a chip 5 connected via transmission line 22 to antenna 6, the next layer 12 comprises the resonant element 7 connected to a ground potential (not shown) via a dissipating element (not shown). The hearing aid 1 further comprises a battery 38 and a sound tube 39. The resonant element 7 may be connected to the ground potential via battery 38 to recharge battery 38.

Figure 8:
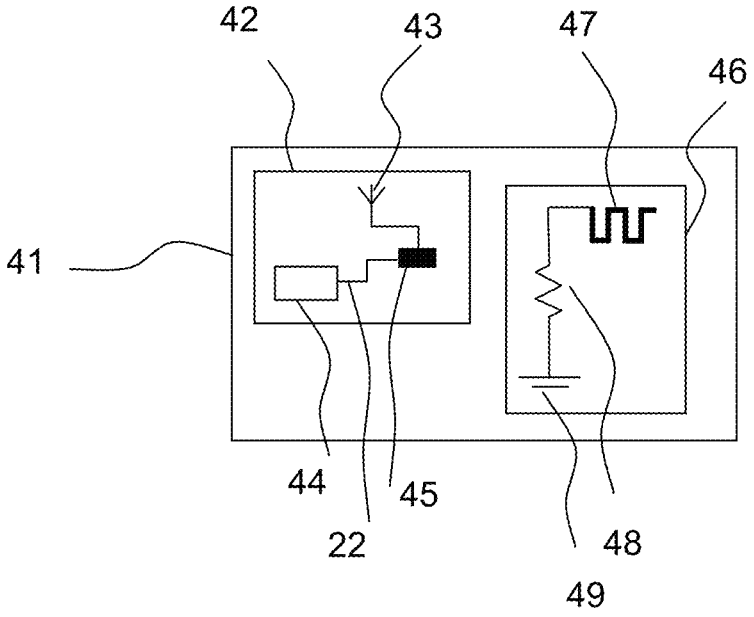
FIG. 8 shows another embodiment wherein the resonant element is provided separate from the electrical circuitry.

In FIG. 8, another embodiment is shown. In a hearing aid, an accessory device or an electronic device 41, the electrical circuitry 42 is shown to comprise electrical component 44, IC chip 45, transmission lines 22 and antenna 43. The filter component 46 is positioned within the near field of electrical circuitry 42 and comprises resonant element 47 connected to ground potential 49 via dissipating element 48. By engineering the resonant element 47 to correspond to a frequency of unwanted electromagnetic radiation from electrical circuitry 42, the unwanted electromagnetic radiation is captured by resonant element 47 and dissipated through dissipating element 48.

It is envisaged that also other implementations of the resonant element implementing a filter are included with the present disclosure. The resonant element must be positioned in the near-field of the electrical circuitry to be filtered, therefore, any number of implementations may be possible, the resonant element may for example be provided on the same substrate as the electrical circuitry, on a separate substrate with respect to the electrical circuitry, such as on a separate printed circuit board, the resonant element may be provided in a housing element of the hearing aid or the electronic device, etc.

In accordance with different embodiments, the following items are provided:

1. A hearing aid comprising
   - a microphone for reception of sound and conversion of the received sound into a corresponding first audio signal,
   - a signal processor for processing the first audio signal into a second audio signal compensating a hearing loss of a user of the hearing aid,
   - a speaker that is connected to an output of the signal processor for converting the second audio signal into an output sound signal,
   - a transceiver connected to the signal processor for wireless data communication interconnected with an antenna for emission and reception of an electromagnetic field,
   - an electrical circuitry comprising the signal processor, the transceiver,
   - interconnecting transmission lines, antenna structures and/or further electrical components, the electrical circuitry extends over an area of a support substrate, wherein the hearing aid further comprises a resonant element positioned within the near field of the electrical circuitry to terminate and dissipate unwanted electromagnetic radiation from at least a part of the area.
2. A hearing aid according to item 1, wherein the resonant element implements a notch filter filtering the unwanted electromagnetic radiation.
3. A hearing aid according to item 1 or 2, wherein the resonant element is positioned outside any signal paths of the electrical circuitry.
4. A hearing aid according to any of the previous items, wherein the resonant element is a parasitic antenna element.
5. A hearing aid according to any of the previous items, wherein the resonant element is substantially electrically conductive.

6. A hearing aid according to any of the previous items, wherein the antenna is configured to have a first resonant frequency, and wherein the resonant element is configured to have a second resonant frequency.
7. A hearing aid according to item 6, wherein the first resonant frequency is different from the second resonant frequency.
8. A hearing aid according to any of the previous items, wherein the resonant element is configured to have a resonance frequency being within +/−10%, such as within +/−15%, such as within +/−20% of a frequency emitted by the hearing aid transceiver.
9. A hearing aid according to any of the previous items, wherein power radiated from the hearing aid at a resonant frequency of the resonant element is less than power radiated from the hearing aid transceiver at a first frequency.
10. A hearing aid according to any of the previous items, wherein the resonant element is suitable for radiating an electromagnetic field at radio frequencies greater than 1 GHz.
11. A hearing aid according to any of the previous items, wherein the resonant element is suitable for radiating a first power at a first resonant frequency and a second power at a frequency different from the first frequency, the first power being greater than the second power.
12. A hearing aid according to any of the previous items, wherein the resonant element is a near field resonating parasitic element.
13. A hearing aid according to any of the previous items, wherein the resonant element is configured to be positioned in the near field of at least two electrical components, where the electrical components are transmission lines, bonding wires, IC chips, transceivers, capacitors and/or resistors.
14. A hearing aid according to item 13, wherein the resonant element is positioned to filter unwanted electromagnetic radiation from an area comprising the at least two electrical components.
15. A hearing aid according to any of the previous items, wherein the resonant element is connected to a ground potential through energy dissipating means.
16. A hearing aid according to any of the previous items, wherein the resonant element is a meander shaped element or a split ring resonator element.
17. A hearing aid according to any of the previous items, wherein the resonant element is a planar element.
18. A hearing aid according to any of the previous items, wherein the electrical circuitry has a first length and a first width.
19. A hearing aid according to any of the previous items, wherein the resonant element has a first section, the length of the first section being greater than the first length and the width of the first section being less than the first width.
20. A hearing aid according to any of the previous items, wherein a first section of the resonant element extends in a first direction and a second section of the resonant element extends in a second direction, the first direction being non-orthogonal to the second direction.
21. A hearing aid according to any of the previous items, wherein the resonant element comprises an open loop.
22. A hearing aid according to any of the previous items, wherein the resonant element has a length being at least one quarter of a wavelength at twice the operating frequency of the transceiver, or a length being at least a quarter of a wavelength at the unwanted frequency, or a length being at least a quarter of a wavelength at twice the unwanted frequency.
23. A hearing aid according to any of the previous items, wherein the resonant element has a length being at least one wavelength at twice the operating frequency of the transceiver, a length being at least one wavelength at the unwanted frequency, or a length being at least one wavelength at twice the unwanted frequency.
24. A hearing aid according to any of the previous items, wherein a capacitance of the resonant element is greater than zero.
25. A hearing aid according to any of the previous items, wherein the electrical circuitry is provided on a printed circuit board, and wherein the printed circuit board has a first layer being a top signal layer comprising at least a part of the electrical circuitry, a second, middle layer comprising the resonant element and a third, bottom layer comprising a ground plane.
26. A hearing aid according to any of the previous items, wherein the frequency of the hearing aid antenna is at least 1 GHz.
27. A hearing aid according to any of the previous items, wherein the resonant element is configured to filter signals at about 2.7 GHz.
28. A hearing aid according to any of the previous items, wherein the electrical circuitry comprises digital circuits.
29. A hearing aid according to any of the previous items, wherein the resonant element is connected to a ground potential through a battery of the hearing aid.
30. A hearing aid according to item 29, wherein the battery is charged by current captured by the resonant element.
31. A hearing aid according to any of the previous items, wherein the parasitic element does not re-radiate received electro-magnetic radiation
32. A hearing aid accessory comprising
a signal processor for processing signals,
a transceiver connected to the signal processor for wireless data communication interconnected with an antenna for emission and reception of an electromagnetic field,
an electrical circuitry comprising the signal processor, the transceiver,
interconnecting transmission lines, and/or further electrical components, the electrical circuitry extends over an area of a support substrate,
wherein the hearing aid accessory further comprises a resonant element being positioned within the near field of the electrical circuitry to terminate and dissipate unwanted electromagnetic radiation from at least a part of the area.
33. An electronic device having an electromagnetic filtering element for reducing unwanted electromagnetic radiation, the electronic device comprising an electrical circuitry having at least one radiator, (such as a radio, a transceiver, an oscillator, a transmission line), the electrical circuitry extending over an area of a support substrate, the electromagnetic filtering element comprising a resonant element being positioned within the near field of the electrical circuitry to terminate and dissipate unwanted electromagnetic radiation from at least a part of the area.
34. A method of reducing or eliminating electromagnetic noise from an electrical circuitry extending over an area of a support substrate, the electrical circuitry having a radiator configured to radiate in a first frequency band, the electromagnetic noise being radiated from the electrical circuitry in a second frequency band different from the first frequency band, the method comprising receiving the electromagnetic noise radiated from at least a part of the area by a resonant element positioned in the near field of the electrical circuitry, the resonant element being configured to resonate in the second frequency band, dissipating the electromagnetic noise received from at least a part of the area by the resonant element through a connection to a ground potential through a dissipating element.

35. A hearing aid, a hearing aid accessory or an electronic device comprising a signal processor for processing an incoming signal, a transceiver connected to the signal processor for wireless data communication interconnected with an antenna for emission and reception of an electromagnetic field, an electrical circuitry comprising at least one of the signal processor, the transceiver, interconnecting transmission lines, antenna structures and/or further electrical components, wherein the hearing aid, the hearing aid accessory, or the electronic device further comprises a resonant element being provided within the near field of the electrical circuitry to terminate and dissipate unwanted electromagnetic radiation from at least a part of the area.

Although particular embodiments have been shown and described, it will be understood that it is not intended to limit the claimed inventions to the preferred embodiments, and it will be obvious to those skilled in the art that various changes and modifications may be made without departing from the spirit and scope of the claimed inventions. The specification and drawings are, accordingly, to be regarded in an illustrative rather than restrictive sense. The claimed inventions are intended to cover alternatives, modifications, and equivalents.

The invention claimed is:

1. A hearing aid comprising:

a hearing aid housing;

a microphone for reception of sound and conversion of the received sound into a corresponding first audio signal;

a signal processor for processing the first audio signal into a second audio signal compensating a hearing loss of a user of the hearing aid;

a speaker that is connected to an output of the signal processor for converting the second audio signal into an output sound signal;

a transceiver connected to the signal processor for wireless data communication; and an antenna for emission and reception of an electromagnetic field, the antenna coupled with the transceiver;

wherein the signal processor, the transceiver, the antenna, and interconnecting transmission lines form a circuitry extending over an area of a support substrate, and wherein the hearing aid further comprises a resonant element in the hearing aid housing, the resonant element located within a near field of the circuitry to dissipate unwanted electromagnetic radiation from at least a part of the circuitry.

2. The hearing aid according to claim 1, wherein the resonant element comprises a notch filter filtering the unwanted electromagnetic radiation.

3. The hearing aid according to claim 1, wherein the resonant element comprises a near field resonant parasitic element positioned outside signal paths of the circuitry.

4. The hearing aid according to claim 1, wherein the area comprises at least two electrical components.

5. The hearing aid according to claim 1, wherein the resonant element is connected to a ground potential through an energy dissipating component.

6. The hearing aid according to claim 1, wherein the antenna has an operating frequency that is at least 1 GHz.

7. The hearing aid according to claim 1, wherein the resonant element is configured to filter signals at about 2.7 GHz.

8. The hearing aid according to claim 1, further comprising a battery, wherein the resonant element is connected to a ground potential through the battery of the hearing aid.

9. The hearing aid according to claim 8, wherein the battery is charged by current captured by the resonant element.

10. The hearing aid according to claim 1, wherein the resonant element comprises a meander shaped element.

11. The hearing aid according to claim 1, wherein the resonant element comprises a split ring resonator element.

12. The hearing aid according to claim 1, wherein the resonant element comprises an electromagnetic resonant element.

13. The hearing aid according to claim 1, further comprising a transmission line connected to the microphone, wherein the resonant element is separate from the transmission line.

14. The hearing aid according to claim 1, wherein the resonant element has an end that is electrically unconnected to the microphone.

15. The hearing aid according to claim 1, wherein at least a part of the circuitry is implemented on a printed circuit board, and the resonant element is located between two layers of the printed circuit board.

16. The hearing aid according to claim 1, wherein the resonant element is mechanically secured to a component located within the hearing aid housing.

* * * * *